US006062585A

United States Patent [19]

Hess

[11] Patent Number: 6,062,585

[45] **Date of Patent: *May 16, 2000**

[54] SKI CONSTRUCTION

[76] Inventor: Eugen Hess, Solitudeallée 61, D-71636 Ludwigsburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/532,826

[22] PCT Filed: Apr. 27, 1994

[86] PCT No.: PCT/DE94/00467

§ 371 Date: Oct. 26, 1995

§ 102(e) Date: Oct. 26, 1995

[87] PCT Pub. No.: WO94/25124

PCT Pub. Date: Nov. 10, 1994

[30] Foreign Application Priority Data

Apr. 27, 1993 [DE] Germany ..... 93 06 333

[51] Int. Cl.[7] ..... A63C 5/048

[52] U.S. Cl. ..... 280/608

[58] Field of Search ..... 280/608, 607, 280/609, 601

[56] References Cited

U.S. PATENT DOCUMENTS

| | | | |
|---|---|---|---|
| 3,758,127 | 9/1973 | Doyle et al. | 280/607 |
| 3,871,671 | 3/1975 | Bildner | 280/608 |
| 4,147,377 | 4/1979 | Plenk | 280/607 |
| 5,083,810 | 1/1992 | Minidis | 280/608 |

FOREIGN PATENT DOCUMENTS

| | | | |
|---|---|---|---|
| 693373 | 9/1964 | Canada | 280/608 |
| 3139119 | 4/1983 | Germany | 280/609 |
| 324085 | 9/1933 | Italy | 280/608 |
| 628308 | 11/1961 | Italy | 280/609 |
| 295706 | 1/1954 | Switzerland | 280/608 |

*Primary Examiner*—Eric Culbreth
*Attorney, Agent, or Firm*—Paul Vincent

[57] ABSTRACT

A ski having a longitudinally extending core, a longitudinally extending running board, which defines a running surface, and longitudinally extending edges extending from each longitudinal side of the running board. Each longitudinally extending edge includes a substantially inelastic external edge. Each substantially inelastic external edge and at least a portion, of its associated longitudinally edge being situated upwardly relative to the running board and define thereby a recess which extends over the whole length of the ski. Each external edge being situated at an outer side of its respective recess.

24 Claims, 5 Drawing Sheets

Fig. 8
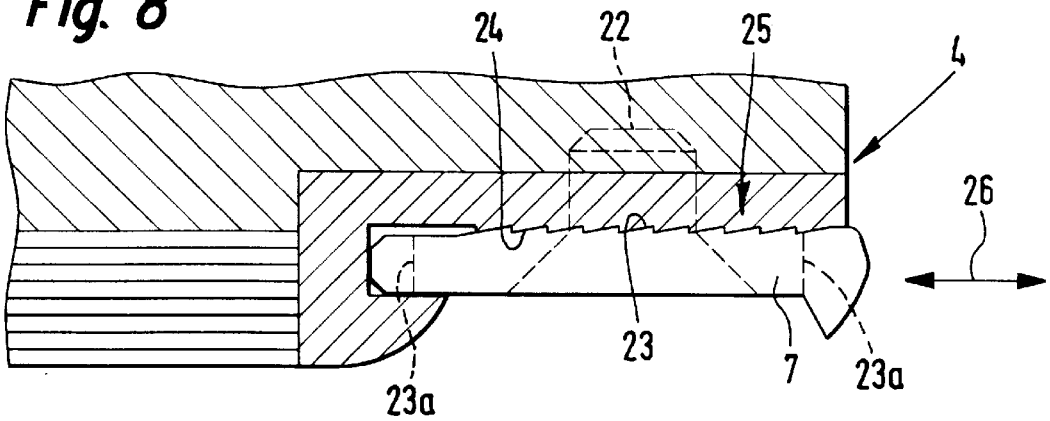
Fig. 9
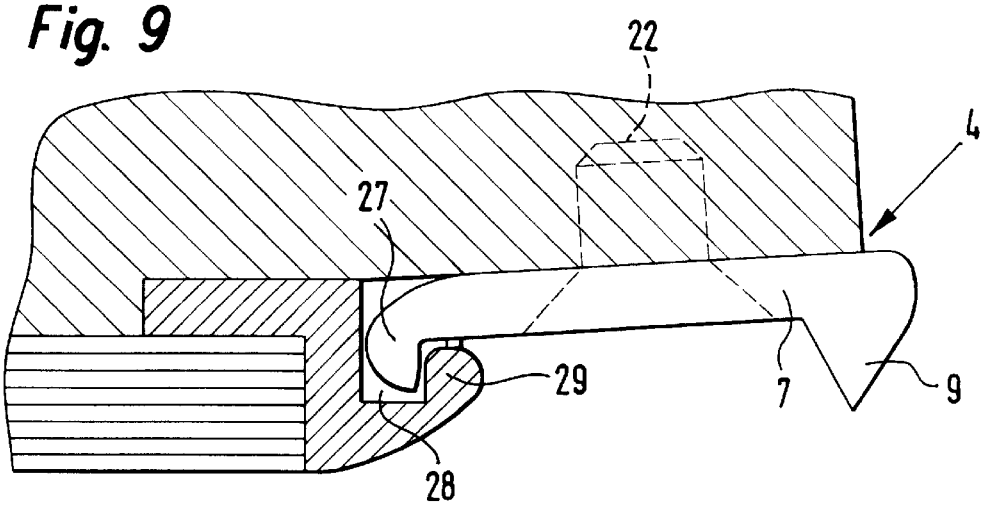
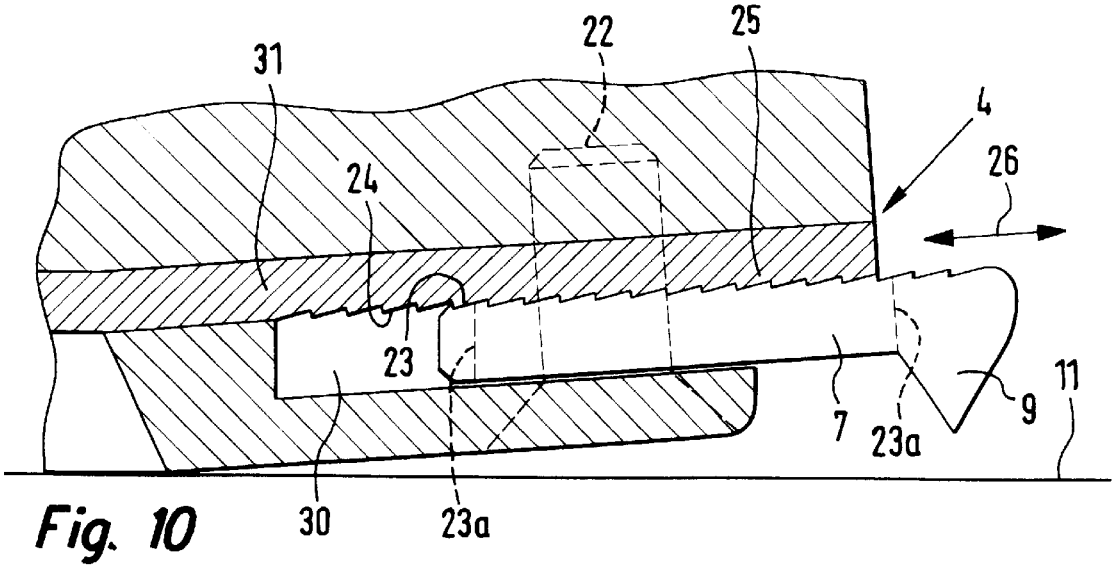
Fig. 10

SKI CONSTRUCTION

BACKGROUND OF THE INVENTION

1. Field of the Invention

The present invention relates to a ski comprising a basic core with a running surface comprising longitudinal edges, the bottom side of the longitudinal edges essentially consisting of inelastic external edges and a recess provided in the lengthwise direction of the ski between the external edge and the running surface.

2. Related Art

German utility model DE-GM 87 05 677 discloses a snow-sliding board consisting of a core with a profiled lower face. This profiled lower face comprises a flat area serving as a running surface. Longitudinal elastic, winged edges are provided laterally adjacent to this face. The area serving as the running surface covers about 30 percent of the cross-section, the remaining 70 percent being covered by the longituidinal edges. This snow-sliding board is designed as a snowboard which moreover comprises an extremely narrow running surface and widely salient edges which are elastically deformable to assist in turning. Even though these edges offer advantages when used as snowboards, they are unsuitable for skis such as monoskis, downhill skis, cross-country skis and even for snowboards with a running surface extending over the whole width.

German utility model DE-GM 88 06 015 discloses a slalomtype downhill ski with steel edges and recesses provided between the external edges and the running surface. External edges of this type are inelastic and are, therefore suited for this kind of skis. However, since these external edges are only provided at the midsection of the ski, they will not contribute to the longitudinal stability of the ski. Moreover, these external edges are located at the level of the contact or running surface of the ski with a consequence that the edges are permanently in action and the ski will be difficult to maneuver because the edges will continuously cut into the snow. This feature while it might be of advantage for slalom skiing, does not, however, not meet the requirements of an allround ski.

SUMMARY OF THE INVENTION

It is, therefore, an object of the present invention, to provide a ski which, while not essentially differing in appearance from a conventional ski, allows for a good grip and improved stability, and is easy to handle. In addition, the gripping power of the edges should not only remain effective for a short time after grinding, but should be retained over a long period of time.

In the present invention, this problem is solved by the feature that the external edge is installed at an angle of more than 0 degrees in relation to the running surface and that the external edges extend over the whole running surface of the ski.

Since the ski according to the present invention features external edges extending over the whole length of the ski, the latter will offer an essentially improved directional stability and longitudinal guidance at not only its midsection, which, as a rule, is fitted with a binding, but also the tip and the tail of the ski are fitted with the external edge.

A further advantage of the present invention is to be seen in the fact that the external edge of the ski is installed at a distance from the running surface so that the external edge is not permanently engaged. This advantage can already be attained by inclining the edge with a slight angle towards the running surface, for instance by only one or two degrees, in this manner increasing the distance between the external edge and the ground by one to two millimeters. Since the external edges are, in addition, inelastic, their geometry will not change when the edge is subjected to a load, which essentially improves directional stability.

If the edge wears as a result of grinding, the gripping power of the ski will be retained, even if the edge has become relatively blunt because the hooked form of the external edge remains intact. As to its running features, this particular ski configuration does not differ from conventional skis.

The external edge is preferably located at a rail. In the case of a conventional manufacturing process, this rail can replace the traditional metal edge. The conversion of conventional skis to the configuration according to the present invention is, therefore, very simple.

In a preferable embodiment, the recess can be bevelled, i.e. fashioned as a groove or a flute. The most suitable form for an actual use can be selected.

In another embodiment of the present invention the external edge is relocated in certain sections, for instance the midsection.

Safer running charasteristics can be achieved by providing sharp external edges, rounded or bevelled in the direction of the running surfaces. Tilting towards the external edge will be prevented or minimized by rounding or bevelling of the external edges. This will reduce the risk of injury, while maintaining the sharpness of the edge and retaining a safe grip of the ski on ice-covered, slippery snow, while the effort needed for turning or slalom racing is reduced. The skier can thus actually stick to the edges of his skis.

The external edge is preferably integrated into a replaceable rail mounted on the ski. In another embodiment of the present invention, the rail can be mounted on the ski and its position in relation to the longitudinal axis or the running surface of the ski can be adjusted by means of a holding or control device. Worn-out and/or damaged external edges of the ski can thus be replaced by new ones or by rails with other geometries. The control device can be utilized for changing the overall running characteristics, gripping power, turning properties etc. of the ski, permitting, on the one hand, an adaptation of the ski to the running experience of the skier, and to the snow conditions on the other.

In another embodiment of the present invention, the rail and the control device are mutually interlocked allowing for the position of the rail to be defined in relation to the ski. The use of a saw-tooth system does on the one hand ensure an exactly defined location of the edge in relation to the running surface, on the other hand facilitates mounting as the saw teeth will only have to be clamped in place.

The control device is preferably installed in parallel to the contact/ground level or at an angle to the latter. It is thus possible to use the control device for adjusting the distance between external edge and ground level or between the external edge and the longitudinal axis of the ski.

High resistance to wear is achieved by—at least partial manufacture of the lateral edges of hard metal, or a hardened steel. The external edges of cross-country or touring skis can, for instance, also be fitted with edges of a rigid plastic material.

A further developed embodiment of the present invention is scheduled to include a removable end cap, removal of which will allow backward withdrawal and—if necessary—replacement of the rail/edge. In this manner, it is, for instance, also possible to adjust the position of the edge in relation to the ski, provided the latter is equipped with a control device.

In an independents embodiment of the present invention, the running surface of the ski may be flat, convex, V-shaped, or V-shaped with a flat midsection. The running surface according to the present invention increases the dynamic properties of the ski so as to reduce stresses occurring during frequent turns, especially during slalom races, because the initiation of the turning movement is facilitated. The running surface according to the present invention can be mounted on the ski either separately or in combination with the receded external edge.

In a preferred embodiment of the present invention, the external edge is designed with several openings, excavations or the like extending over its whole length, in which case these openings, excavations or the like are arranged at equal distances and, in particular, have a U-shape, V-shape or are provided with saw teeth. This facilitates rapid turns of the ski as the snow can escape laterally through the recesses. In this manner, the ski can easily slide laterally. This configuration of a ski is, for instance, particularly suited for use in slalom racing. The saw tooth system offers the advantage that sideward sliding during running has no braking effect.

Further advantages, characteristics and details of the present invention are specified in the subsequent detailed description indicating individual preferred embodiments of the present invention with reference to the drawings.

BRIEF DESCRIPTION OF THE DRAWINGS

FIGS. 8–10 show embodiments of replacable rails; and

DETAILED DESCRIPTION OF THE PREFERRED EMBODIMENTS

Figure 1:
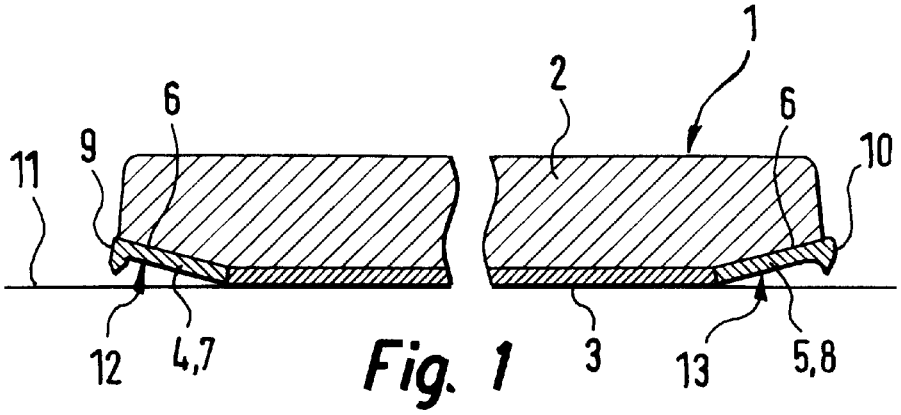
FIGS. 1–3 are cross-sectional views respectively through the embodiments of the ski according to the present invention featuring differently fashioned external edges.
Figure 2:
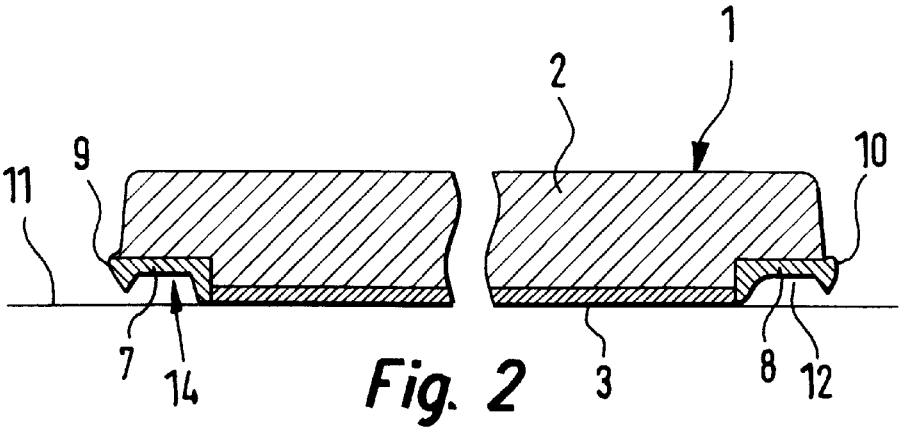
Figure 3:
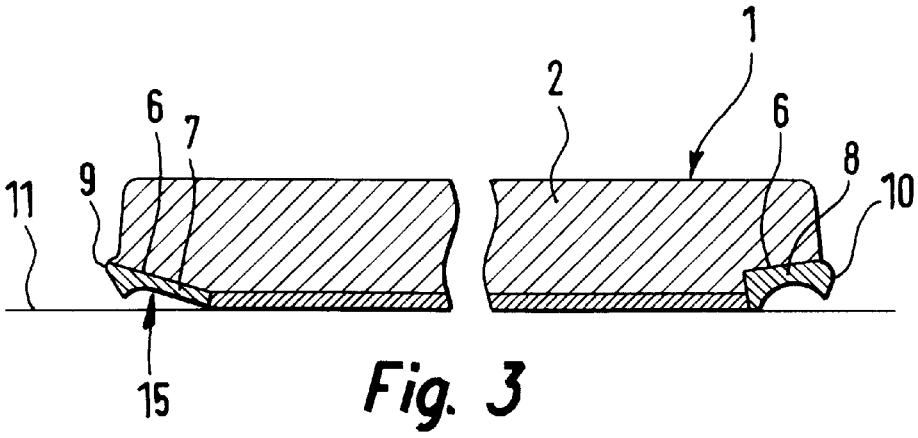

As will be clearly noted from the cross-sections through a ski typically exemplified in FIGS. 1–3, in all cases identified as 1, the Ski comprises a basic core 2 with a running board surface defining a running surface 3 as well as two longitudinal edges 4 and 5. The structure of -he basic core can differ greatly and is not represented here for the sake of simplicity. It will be clearly noted that the lateral spaces at the lower face of the basic core 2 are bevelled at 6 and that at these bevels 6 longitudinal edges 4 and 5 are provided. The latter are fashioned as rails 7 and 8 each of which show an external edge 9 and 10 at their extreme ends. These external edges 9 and 10 are of a hook-like shape and point in the direction of the supporting surface 11 for ski 1. A free space of about one to two millimeteres is left between the supporting surface 11 and the external edge 9 and 10 respectively. The free space is formed by mounting rails 7 and 8 at the bevel 6.

In addition, a recess 12 is represented between the external edge 9 or 10 of running surface 3, the recess being formed by a bevel 13, respectively a bevelled section of rail 7 or 8. FIG. 2 shows a recess 12 which is formed by a groove 14 provided at rail 7 or 8 and in FIG. 3 the recess 12 is formed by a hollow molding 15. Moreover it will be noted that the external edge 9 or 10 pointing downwards in the embodiment shown in FIG. 1 is sharp-edged, whereas the longitudinal side of rail 7 is smooth and that of rail 8 is rounded. This also applies to the embodiments shown in FIGS. 2 and 3. In the embodiment shown in FIG. 2 rails 7 and 8 are not mounted on bevel 6 but are essentially horizontal, the free space between the external edges 9 and 10 and the supporting surface 11 being achieved by a respectively smaller dimension of the external edges 9 and 10. In certain embodiments the external edge 9 and 10 can be partially made of hardened steel or a hard metal. Alternatively, it can be manufactured of a rigid plastic material.

Figure 4:
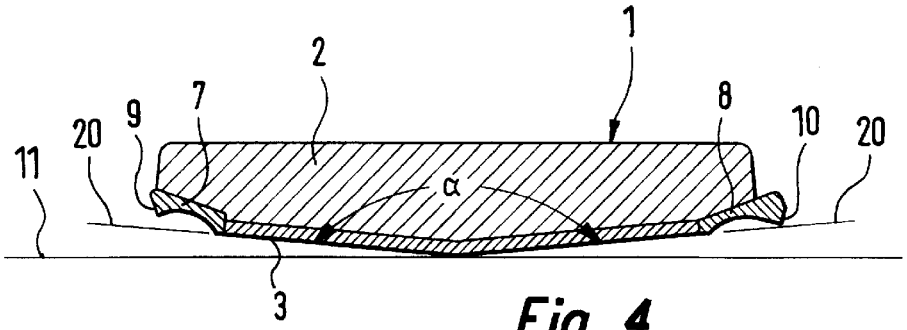
FIGS. 4–6 are cross-sectional views respectively through the embodiments of the ski according to the present invention featuring differently fashioned external edges and differently fashioned running surfaces.
Figure 5:
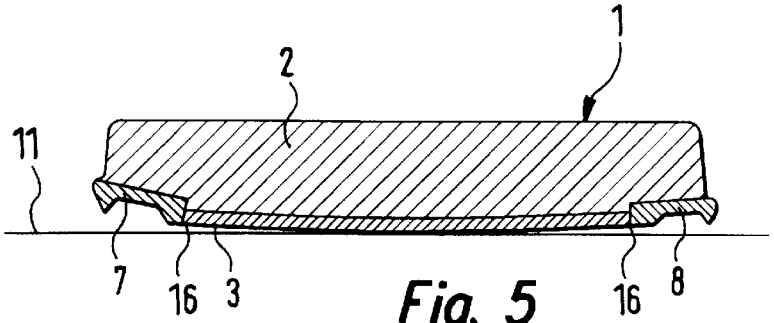
Figure 6:
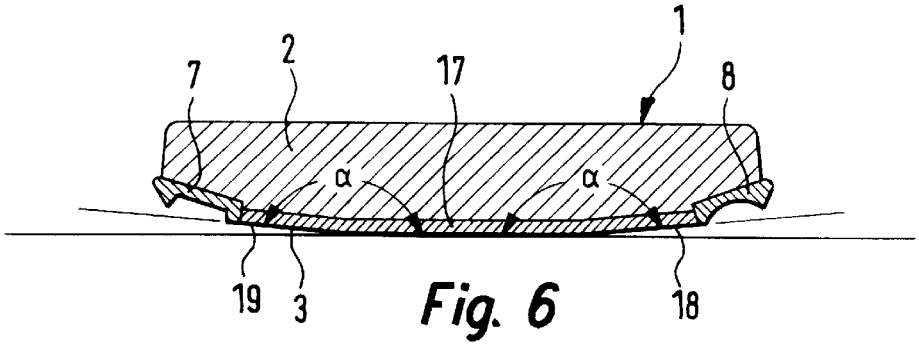

The cross-sections of skis 1 shown in FIGS. 4 to 6 comprise rails 7 and 8 which are fashioned in accordance with the embodiments presented in FIGS. 1 to 3, which, however, is not an essential requirement. Yet the running surface 3 of the basic core 2 differs from that represented in FIGS. 1–3. In the embodiment shown in FIG. 4 the running surface 3 is fashioned in the shape of a V, the apex angle alpha of which can vary between 170 and 180°. The running surface 3 of the embodiment shown in FIG. 5 is rounded to a convex form or bent so that even in this case the lateral edges 16 of running surface 3 are keeping a distance to the supporting surface 11.

In the embodiment as per FIG. 6 the running surface 3 comprises a flat midsection 17 and two offset lateral sections 18 and 19. Angle $\alpha$ between the flat section 17 and the lateral section 19 is 175 to 180°.

As can be clearly recognized in FIGS. 4–6, even in the case of the unevenly fashioned running surfaces 3 the external edges 9 and 10 form a free space in relation to the straight line 20 of running surface 3 so that ski 1 will not immediately engage with the external edge 9 or 10 as a turning movement is initiated, but only when this is intentionally begun by tilting the ski 1.

Figure 7:
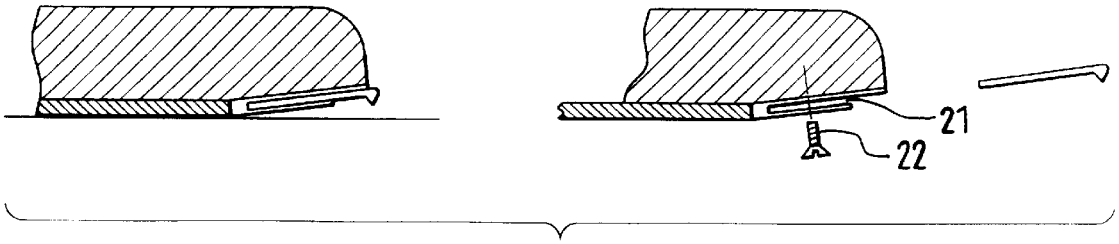
FIG. 7 is a partial cross-sectional view through an embodiment of the ski according to the present invention with an external edge incorporated into a replacable rail.

FIG. 7 shows an embodiment of a replacable rail 7 which can be inserted into slot 21 located at the longitudinal edge of ski 1, for instance at a side. Insertion in the longitudinal direction is also imaginable. Several bolts 22 are provided for fastening of rail 7 in slot 21 of the longitudinal edge 4.

FIGS. 8–10 represent embodiments of a replacable rail 7 which is likewise fastened by means of bolts 22 at the longitudinal edge 4. The embodiment shown in FIG. 8 comprises a rail 7 which is provided with saw teeth 23 at its upper side, corresponding to saw teeth 24 of a control device 25. Rail 7 is inserted into the control device 25 in a manner that saw teeth 23 and 24 engage positively. Rail 7 is then fastened at the longitudinal edge 4 by means of bolts 22. Rail 7 can, for instance, be adjusted by loosening bolts 22 and shifting rail 7 in the direction of the double arrow 26. Rail 7 is then again fastened by bolts 22.

In the embodiment shown in FIG. 9 rail 7 comprises a claw 27 at the end opposite to the external edge 9 which engages with an undercut 28 of an absorbing element 29. The absorbing element 29 absorbs the forces acting on rail 7. Although rail 7 is mounted to allow replacement it is not adjustable.

In the embodiment shown in FIG. 10, rail 7 is inserted into a slot 30 provided at the longitudinal edge 4 where it is likewise fastened by means of bolts 22. Moreover, rail 7 features a saw tooth system and, for instance, a lower flange 31 of ski 1 made of aluminum as well as a corresponding saw tooth system 24. This rail 7 can also be adjusted in the direction of the double arrow 26. As shown in FIG. 9, the control device 25 can have the same inclination as the longitudinal edge 4, it can, however, also be located at a horizontal level in the longitudinal edge 4. By an adjustment of rail 7 in the direction of the double arrow 26 it is possible to change the space between the external edge 9 and the supporting surface 11 as well as the distance between the external edge 9 and the longitudinal median line of ski 1.

For the embodiments of FIGS. 7, 8 and 10, means for adjusting the rail position 23*a* (shown schematically) can be fashioned in the rail 7, through which the bolt 22 passes. As clearly shown in FIG. 10, the rail 7 forms an angle with respect to the running surface 3.

Figure 11:
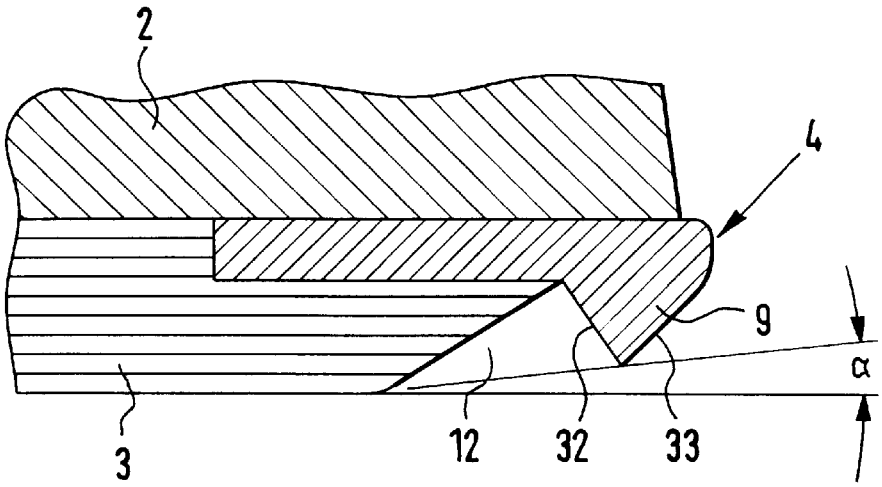
FIGS. 11–15 show embodiments of further variants.
Figure 12:
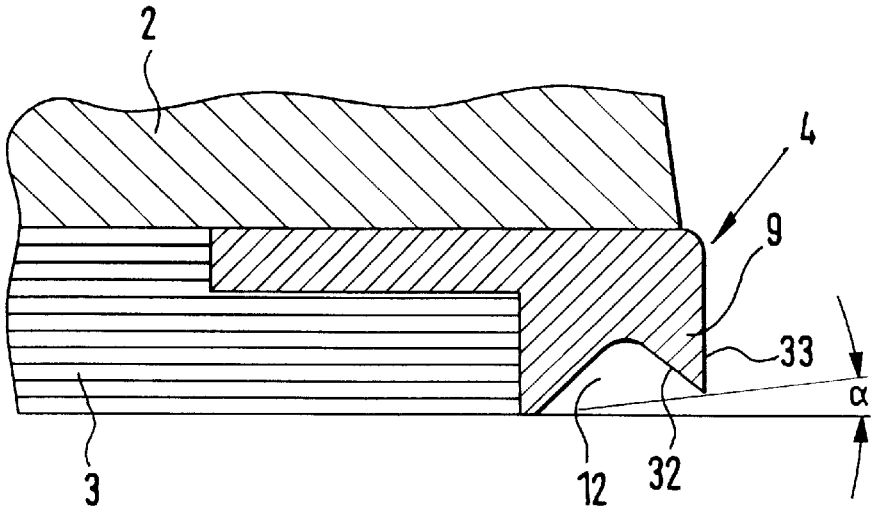
Figure 13:
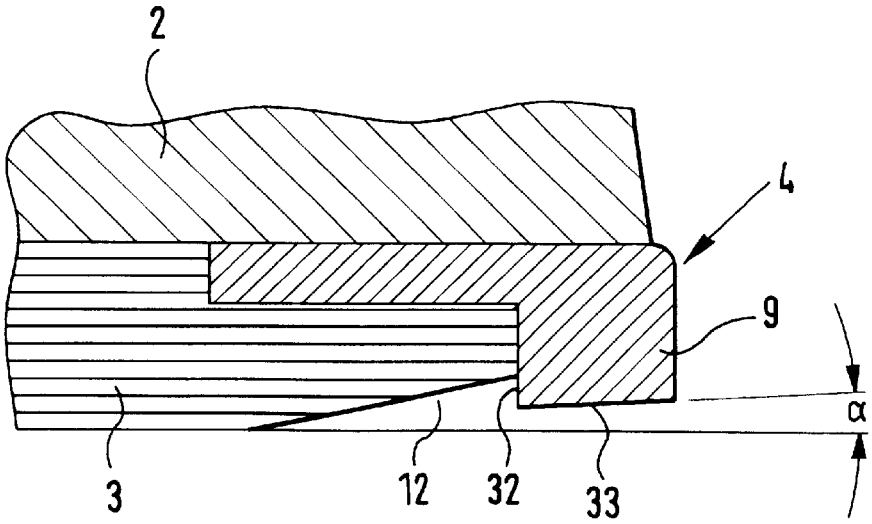
Figure 14:
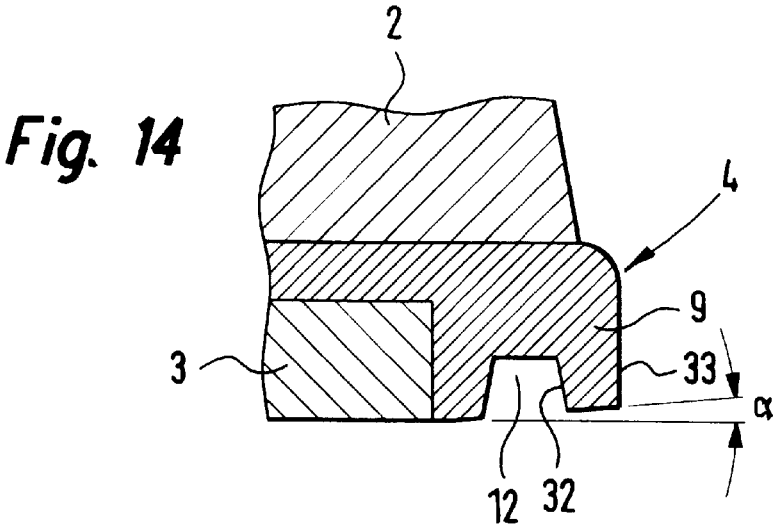

In the embodiments shown in FIGS. 11–15 the external edge 9 comprises an internal surface 32 and an external surface 33. In the embodiments shown in FIGS. 11 and 12 the internal and external flanks form a V-shape, whereas in the case of the embodiment shown in FIG. 13 the interior surface 32 is essentially vertical and the exterior surface 33 is shaped in a slightly inclined upward gradient. In the embodiments of FIGS. 11 and 13, recess 12 is achieved by milling off the edge of running surface 3 off in an angle thus providing the recess 12 between running surface 3 and the interior edge 32. The longitudinal edge 4 of the embodiment shown in FIG. 12 can, for instance, be a conventional longitudinal edge which, if necessary, could be machined to achieve the shape shown in the Figure.

In the case of the longitudinal edge shown in FIGS. 12–15 the recess 12 is integrated into the longitudinal edge 4 and can be V-shaped or formed as a groove. As will be clearly recognized, the external edge 9 is positively recessed so as to obtain a distance of 1–2 millimeters toward the level of running surface 3, respectively an angle delta of 1 to 5°, typically moving the recess back by 2°. The longitudinal edges 4 are dimensioned like conventional longitudinal edges and can be mounted on the ski in the same manner. The particular form of the profiles can be selected either before or after mounting on the ski.

Figure 15:
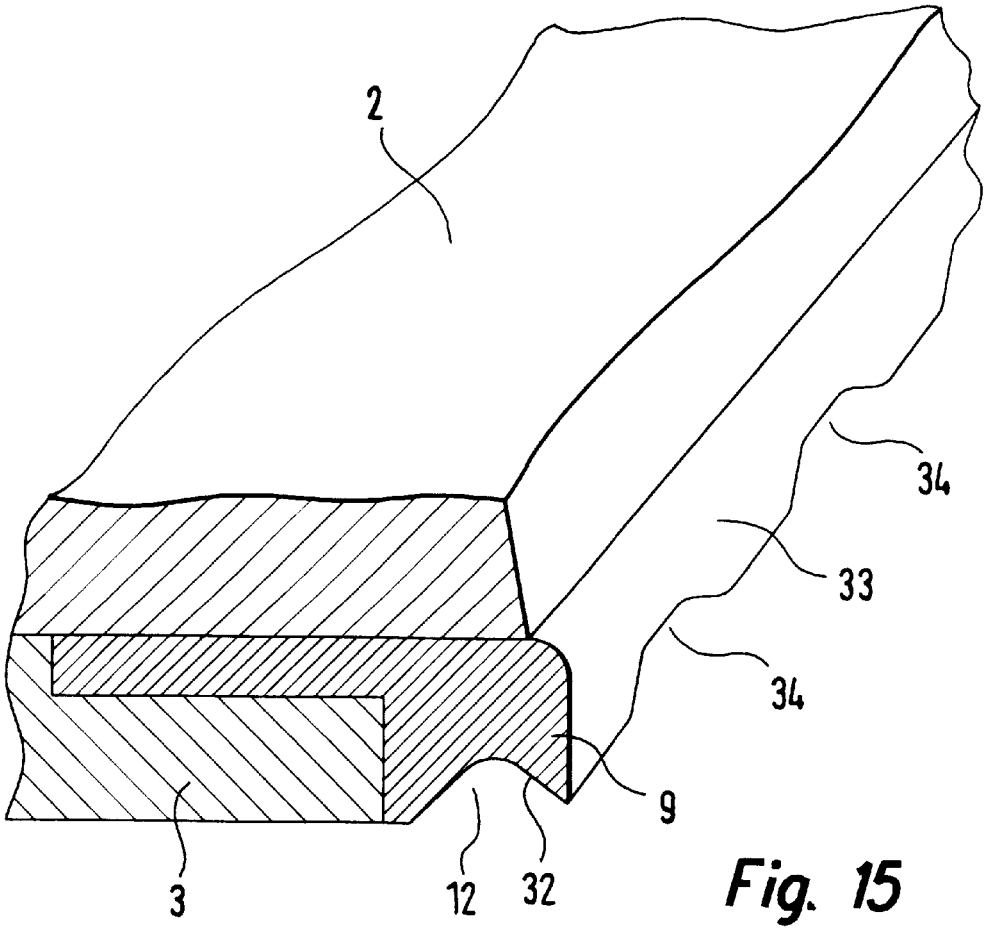

In the embodiment shown in FIG. 15 the external edge 9 has been provided with several openings 34 which are connected to recess 12. These openings can be inserted into the external edge by rolling in or milling in or rolling down or in another manner. In any case, the external edge 12 will be interrupted by several openings.

Ski 1 in accordance with the present invention will not only facilitate maneuvering but will be much safer to use on ice and slippery ground conditions because is has an improved gripping power. In addition, it can be adapted to the skiing proficiency of the user and/or the actual snow conditions thanks to the possibility of replacing rails 7 and/or 8.

I claim:

1. A ski comprising:

a longitudinally extending core;

a longitudinally extending running board defining a running surface and longitudinally extending sides; and longitudinal rails extending from each longitudinal side of said running board, wherein:

said rails each define a substantially inelastic external edge; and at least a portion of said rails being situated upwardly relative to said running board defining thereby an angle relative to said running surface which is greater than 0°, each rail also defining one single recess which extends over an entire longitudinal extent of each rail, with each of said substantially inelastic external edges being situated at an outer side of a respective recess, each of said recesses having an inner recess side extending upwardly away from said running surface and generally towards said external edge, an outer recess side extending downwardly substantially towards said external edge, and a recess bottom disposed between said inner recess side and said outer recess side, said recess bottom having a vertical separation above said running surface, said external edge having a inner edge side defined by said outer recess side, an outer edge side extending upwardly away from said running surface and an edge bottom disposed between said outer edge side and said inner edge side, said edge bottom having a vertical separation above said running surface which is less than said recess bottom vertical separation.

2. The ski as defined in claim 1, wherein said recess is formed as a bevel.

3. The ski as defined in claim 1, wherein said recess is formed as a groove.

4. The ski as defined in claim 1, wherein said recess is formed as a flute.

5. The ski as defined in claim 1, wherein each substantially inelastic external edge is situated upwardly in sections relative to said running board.

6. The ski as defined in claim 5, wherein the ski defines a midplane and wherein each substantially inelastic external edge is situated upwardly of said midplane of the ski.

7. The ski as defined in claim 1, wherein each substantially inelastic external edge is sharp-edged and externally beveled in the direction toward said running board.

8. The ski as defined in claim 1, wherein each substantially inelastic external edge is sharp-edged and rounded in the direction toward said running board.

9. The ski is defined in claim 1, wherein each rail is replaceably mounted to the ski.

10. The ski as defined in claim 1, further comprising a housing situated at at least one longitudinal side of said running board adjacent to said longitudinal side of said running board, wherein said rail is replaceably mounted in said housing so that said rail can be displaced transverse to a longitudinal axis of the ski.

11. The ski as defined in claim 10, wherein said housing and said rail each have cooperating saw teeth which engage to fix a position of said rail on the ski.

12. The ski as defined in claim 10, wherein said housing extends parallel to said longitudinally extending running board.

13. The ski as defined in claim 10, wherein said rail is disposed at an angle to said running surface.

14. The ski as defined in claim 1, wherein said external edges are at least partially made of hard metal.

15. The ski as defined in claim 1, wherein said external edges are at least partially made of hardened steel.

16. The ski as defined in claim 1, wherein said external edges are at least partially made of plastic material.

17. The ski as defined in claim 1, wherein said running surface is flat.

18. The ski as defined in claim 1, wherein said running surface is convex.

19. The ski as defined in claim 1, wherein said running surface is V-shaped.

20. The ski as defined in claim 1, wherein said running surface has a flat midsection with upwardly extending ends.

21. The ski as defined in claim 1, wherein said external edges include several openings or the like.

22. The ski as defined in claim 21, wherein said openings are arranged in a regular order.

23. The ski as defined in claim 22, wherein said openings are arranged as saw teeth.

24. The ski as defined in claim 22, wherein said openings are formed from saw teeth.

* * * * *